US006484003B2

(12) United States Patent
Tokutake et al.

(10) Patent No.: US 6,484,003 B2
(45) Date of Patent: Nov. 19, 2002

(54) COLOR IMAGE FORMING APPARATUS WITH RACK HAVING DETACHABLE UNITS

(75) Inventors: Naoto Tokutake; Susumu Tashiro; Motozi Kawamoto; Masakazu Fukuchi; Kazuyoshi Kimura; Susumu Okui; Masahiro Shigetomi; Kosuke Minoshima, all of Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/881,927

(22) Filed: Jun. 14, 2001

(65) Prior Publication Data

US 2002/0031369 A1 Mar. 14, 2002

(30) Foreign Application Priority Data

Jun. 21, 2000 (JP) ..... 2000-186163
Sep. 4, 2000 (JP) ..... 2000-266872
Sep. 18, 2000 (JP) ..... 2000-281841

(51) Int. Cl.[7] ..... G03G 15/00; G03G 15/01; G03G 21/18

(52) U.S. Cl. ..... 399/110; 399/112; 399/121

(58) Field of Search ..... 399/110, 111, 399/112, 113, 121, 302; 347/115, 138, 152

(56) References Cited

U.S. PATENT DOCUMENTS 5,014,094 A * 5/1991 Amitani et al. ..... 399/112
5,444,515 A * 8/1995 Haneda et al. ..... 399/112
5,752,137 A * 5/1998 Haneda ..... 399/112
5,848,329 A * 12/1998 Aoyama et al. ..... 399/111
6,085,051 A * 7/2000 Miyasaka et al. ..... 399/110
6,236,820 B1 * 5/2001 Nakazato et al. ..... 347/138

* cited by examiner

*Primary Examiner*—Joan Pendegrass
(74) *Attorney, Agent, or Firm*—Frishauf, Holtz, Goodman & Chick, P.C.

(57) ABSTRACT

The present invention concerns a color image forming apparatus wherein toner images formed on a plurality of image carriers are primarily transferred onto an intermediate transfer object, and then, are secondarily transferred onto a recording sheet. The color image-forming apparatus includes a plurality of image carriers; a plurality of latent image forming devices to form electrostatic latent images on the image carriers; a plurality of developing devices to develop the electrostatic latent images with toner to form visible toner images on the image carriers; an intermediate transfer member, a longitudinal direction of which is arranged at substantially a vertical direction, and onto which the toner images formed on the image carriers are sequentially transferred in such a manner that the toner images overlap relative to each other so as to form a color toner image on the intermediate transfer member; and a transfer-ring device to transfer the color toner image formed on the intermediate transfer member onto a transfer sheet. The intermediate transfer member and the image carriers are integrated into a rack, and the rack is drawable in substantially a horizontal direction in respect to a mainframe of the color image-forming apparatus.

24 Claims, 9 Drawing Sheets

COLOR IMAGE FORMING APPARATUS WITH RACK HAVING DETACHABLE UNITS

BACKGROUND OF THE INVENTION

The present invention relates to an image forming apparatus employing an electrophotographic system such as a copying machine, a printer and a facsimile machine, and in particular, to a color image forming apparatus wherein toner images formed on a plurality of image carriers by a plurality of image carriers, latent image forming means and developing means are primarily transferred onto an intermediate transfer object, and then, are secondarily transferred onto a recording sheet.

In the case of a conventional color image forming apparatus employing an electrophotographic system, there have been proposed various types of systems wherein a plurality of image forming sections are arranged in parallel in the conveyance direction, and toner images each being different from others in terms of color formed respectively on photoreceptor drums in image forming sections are successively transferred on a recording sheet held on a transfer belt.

There is also known a color image forming apparatus wherein a transfer drum around which a recording sheet fed from a sheet feeding section is wound is used in place of the transfer belt stated above. By transferring toner images visualized by developing means onto the recording sheet wound around the transfer drum successively, a full color image is formed on the recording sheet. After this, the recording sheet is separated from the transfer drum and is subjected to fixing of the toner image conducted by a fixing means to be ejected out.

Further, in another color image forming apparatus, there is also proposed a system wherein a plurality of image forming sections are arranged in parallel, toner images each being different from others in terms of color formed respectively on photoreceptor drums in image forming sections are successively transferred onto an intermediate transfer object for forming superposed primary transfer images, and the primary transfer images are transferred onto a recording sheet held on a conveyance belt.

A color image forming apparatus of a tandem type of this kind having a plurality of photoreceptors wherein a color image is formed through one turn of each of plural photoreceptors can output full color images at higher speed, compared with a color forming apparatus of a multi-rotation type wherein a color image is formed through plural turns of a single photoreceptor.

A plurality of photoreceptors and intermediate transfer objects need to be removed from an apparatus main body because of their maintenance and life-times. Therefore, the structure which makes it easy to remove a plurality of photoreceptors and intermediate transfer objects has been required by the color image forming apparatus of a tandem type.

Since a plurality of photoreceptors, intermediate transfer objects in particular, rotating means to rotate the intermediate transfer objects, and intermediate transfer units including primary transfer means have considerable mass, it has been difficult for a user to draw out plural photoreceptors from positions where the photoreceptors have been mounted in the apparatus main body, and to take out directly intermediate transfer units from positions where the intermediate transfer units have been mounted in the apparatus main body, because it has been difficult to apply the physical power. In particular, it is not easy to pull out the heavy unit horizontally toward the front side of the apparatus main body. Furthermore, a unit such as a photoreceptor and an intermediate transfer object is weak against an impact, and there is a risk that the unit becomes unusable if a part of the unit is touched while it is pulled out. A scratch caused by a shock not only affects images in image forming in a single color but also has possibility that a desired color cannot be reproduced in color image forming, and the scratch turns out to be a fatal defect for a color image forming apparatus.

On the other hand, when each member is provided with its own mechanism to take out each member without interference, a large number of taking-out mechanisms (for example, slide rail mechanisms) are needed. Each taking-out mechanism requires its strength that withstands the weight. This makes an entire apparatus to be large.

The more the mechanism to take out each member individually is increased, the more difficult the positional adjustment between members is. In an image forming apparatus having plural photoreceptors, in particular, it is necessary to conduct superposition of each color in extremely high accuracy. If mutual positional deviation is caused for each maintenance of a unit, it is not possible to reproduce the color desired by a user. Furthermore, an intermediate transfer object is a member on which color toner images each being of a different color are superposed, and relative positions of intermediate transfer objects for plural photoreceptor drums are required to be accurate.

Further, when a color image forming unit of this kind is provided on a copying machine, there are further caused problems. Since a document image reading apparatus is arranged on the upper portion of the copying machine, there is needed a complicated opening/closing mechanism which opens the document image reading apparatus from the upper portion of the apparatus main body. Each of the document image reading apparatus and the opening/closing mechanism has considerable mass, and how to handle them is a problem. If an impact is applied on the document image reading apparatus in the course of opening/closing operations, there are caused problems of difficulty in maintaining accuracy of optical members, parts damages and injures of an operators. Drawing out from the upper portion of the apparatus main body has the aforesaid problems, although it is easy for a user to apply the physical power.

In the image forming apparatus which forms images on both sides of a sheet, a sheet fed from the a sheet feeding means is subjected to transfer and fixing of toner images formed on an image carrier on the first surface of the sheet, and then is branched from the sheet ejection path to be conveyed to a reversing means provided on the lower or upper portion. The sheet thus conveyed is reversed up side down, and then, is made to join a sheet conveyance path again from a sheet feeding section. The sheet which has joined the sheet conveyance path is conveyed to the image carrier again so that a toner image may be transferred onto the second surface of the sheet.

As a method to form images on a sheet from inputted multi-color images, TOKKAIHEI No. 9-006083 discloses an image forming apparatus wherein a plurality of developing units are arranged in parallel on one side of an image carrier representing a belt arranged longitudinally, and a sheet ejection section is provided on the other side, and charging, writing of a latent image and developing are conducted in succession within one turn of one image carrier.

In an image forming apparatus for a color image, when an image carrier on which a toner image is formed and a developing unit are arranged in the longitudinal direction, if joining from the reversing means is conducted in the vicinity of the sheet feeding unit positioned at the lower portion, the image forming apparatus is made to be large in the longitudinal direction, which is a problem.

For example, FIG. 9 is an illustrative diagram of an image forming apparatus showing image forming flows to both sides of a sheet.

In FIG. 9, image forming apparatus 101 is provided with scanner section R, image carrier 110, scorotron charging unit 111, image writing means 112, developing unit 113, transfer means 115, fixing means H, sheet feeding section 117, bypass sheet feeding section 109, reversing means S and with sheet ejection tray T.

The scanner section R reads an image of a document set through an optical system. The image writing means 112 exposes image carrier 110 to light to form a latent image, based on the image read. The latent image formed on the image carrier 110 is developed by developing unit 113 to turn into toner.

On the other hand, the sheet feeding section 117 is provided with a plurality of sheet feeding units 117*a*–117*d* each housing therein sheets in a different size, and a sheet is fed out toward registration roller 141 through first sheet conveyance path P0 by sheet feeding roller 118*a* of the selected sheet feeding unit, for example, of sheet feeding unit 117*a*. The registration roller 141 starts rotating to convey the sheet so that the toner image formed on the image carrier 110 may be synchronized with the sheet.

The sheet conveyed to the registration roller 141 is superposed on the toner image formed on the image carrier 110, and thus, the toner image is transferred onto the sheet. The sheet on which the toner image has been transferred is sent to fixing means H to be fixed, and is ejected to sheet ejection tray T.

When transferring a toner image on the second surface of the sheet on which the toner image has been transferred onto the first surface thereof, the sheet on which the toner image has been formed is fed in second sheet conveyance path G.

On the second sheet conveyance path G, there is provided reversing means S that is equipped with a pair of switchback rollers 143 capable of rotating regularly and inversely and guide 148. The sheet which has been fed in is reversed inside out by switching of the sheet conveyance direction for the switchback rollers 143 c of the reversing means S and switching of the conveyance path of guide 148. The sheet thus reversed is sent to roller unit 118*e* by driving rollers 144 and 145 to join the first sheet conveyance path P0 representing a sheet conveyance path from the sheet feeding section. The sheet which has joined the first sheet conveyance path P0 is sent again to the registration roller 141, and then, is ejected to sheet ejection tray T after the toner image formed on the image carrier is transferred onto the second surface of the sheet and fixed.

Namely, in the conventional image forming apparatus, when forming toner images on both sides of a sheet, the sheet on which a toner image has been transferred on the first surface thereof is reversed inside out by the reversing means, and is made to join the sheet conveyance path coming from the sheet feeding section, and after that, a toner image is transferred onto the second surface of the sheet.

From viewpoints of production cost and easiness of design for an image forming apparatus, the reversed sheet has been made to join the sheet conveyance path in the vicinity of a sheet feeding unit by a roller similar to that of the sheet feeding unit. For example, one sheet feeding unit among plural sheet feeding units has been removed to be used for the reversed sheet to join the conveyance path.

For this reason, when an image carrier on which a toner image is formed and a developing unit are arranged in the longitudinal direction, if joining from the reversing means is conducted in the vicinity of the sheet feeding unit positioned at the lower portion, the image forming apparatus is further made to be large in the longitudinal direction.

When the time for image forming on both sides of a sheet needs to be shortened, the conveyance time for conveying the reversed sheet to the vicinity of the sheet feeding section is a problem.

The invention has been achieved to solve the aforesaid problems, and an object of the invention is, in a color image forming apparatus having a plurality of photoreceptors and intermediate transfer units, to make operations for mounting the aforesaid members and image forming means such as developing means on an apparatus main body and operations for dismounting them from an apparatus main body to be easy and to make maintenance for them to be easy, and to realize prevention of troubles of each member, high accuracy of positions and down-sizing of the total apparatus.

Another object is to reduce a floor space of an apparatus and to reduce a height of an apparatus in the vertical direction, and thereby to realize down-sizing of the total apparatus.

Further object is to shorten the time for image forming on both sides of a sheet and to provide an image forming apparatus requiring less floor space.

SUMMARY OF THE INVENTION

The objects stated above are realized by either one of the following structures.

(1) A color image-forming apparatus, comprising: a plurality of image carriers; a plurality of latent image forming devices to form electrostatic latent images on the image carriers; a plurality of developing devices to develop the electrostatic latent images with toner to form visible toner images on the image carriers; an intermediate transfer member, a longitudinal direction of which is arranged at substantially a vertical direction, and onto which the toner images formed on the image carriers are sequentially transferred in such a manner that the toner images overlap relative to each other so as to form a color toner image on the intermediate transfer member; and a transferring device to transfer the color toner image formed on the intermediate transfer member onto a transfer sheet; wherein at least the intermediate transfer member and the image carriers are integrated into a rack, and the rack is drawable in substantially a horizontal direction in respect to a mainframe of the color image-forming apparatus.

(2) A color image-forming apparatus, comprising: a plurality of image carriers; a plurality of latent image forming devices to form electrostatic latent images on the image carriers; a plurality of developing devices to develop the electrostatic latent images with toner to form visible toner images on the image carriers; an intermediate transfer member to bear a color toner image formed by superimposing the toner images, which are sequentially transferred onto the intermediate transfer member from the image carriers; and a transferring device to transfer the color toner image formed on the intermediate transfer member onto a transfer sheet; wherein at least the intermediate transfer member and the image carriers are integrated into a rack, and the rack is drawable in substantially a horizontal direction in respect to a mainframe of the color image-forming apparatus.

(3) A color image-forming apparatus, comprising: a plurality of image carriers; a plurality of latent image forming devices to form electrostatic latent images on the image carriers; a plurality of developing devices to develop the electrostatic latent images with toner to form visible toner images on the image carriers; an intermediate transfer member, a longitudinal direction of which is arranged at substantially a vertical direction, and onto which the toner images formed on the image carriers are sequentially transferred in such a manner that the toner images overlap relative to each other so as to form a color toner image on the intermediate transfer member; a sheet feeding section to store a transfer sheet and to feed the transfer sheet stored; a first sheet conveyance path, through which the transfer sheet, fed from the sheet feeding section, is conveyed to the intermediate transfer member; a transferring device to transfer the color toner image formed on the intermediate transfer member onto the transfer sheet; a reversing device to reverse a front side back of the transfer sheet, onto a first surface of which the color toner image is already transferred; and a second sheet conveyance path, through which the transfer sheet, reversed by the reversing device, is conveyed to a confluent position with the first sheet conveyance path, so that the transfer sheet re-enters the first sheet conveyance path from the confluent position; wherein the confluent position, at which the second sheet conveyance path joins the first sheet conveyance path, is located at substantially a center of the sheet feeding section and at substantially a lower position of the image carriers.

(4) A color image-forming apparatus, comprising: a plurality of image carriers; a plurality of latent image forming devices to form electrostatic latent images on the image carriers; a plurality of developing devices to develop the electrostatic latent images with toner to form visible toner images on the image carriers; an intermediate transfer member, a longitudinal direction of which is arranged at substantially a vertical direction, and onto which the toner images formed on the image carriers are sequentially transferred in such a manner that the toner images overlap relative to each other so as to form a color toner image on the intermediate transfer member; a sheet feeding section to store a transfer sheet and to feed the transfer sheet stored; a first sheet conveyance path, through which the transfer sheet, fed from the sheet feeding section, is conveyed to the intermediate transfer member; and a transferring device to transfer the color toner image formed on the intermediate transfer member onto the transfer sheet; wherein the intermediate transfer member is located at substantially a upper position of the sheet feeding section, and the transferring device is shaped in a roller and contacts a lower portion of the intermediate transfer member.

BRIEF DESCRIPTION OF THE DRAWINGS

Other objects and advantages of the present invention will become apparent upon reading the following detailed description and upon reference to the drawings in which.

DETAILED DESCRIPTION OF THE PREFERRED EMBODIMENT

Figure 1:
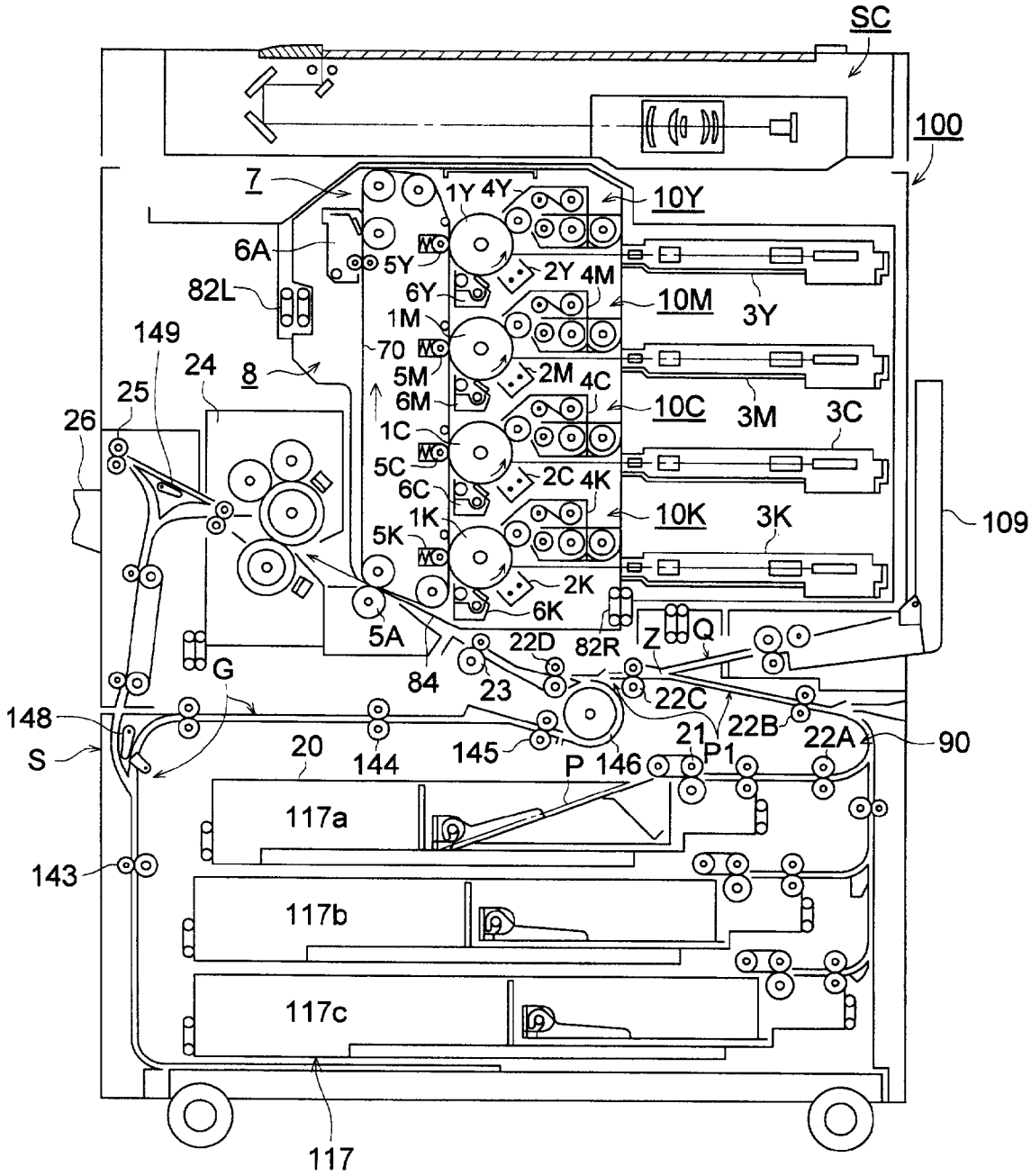
FIG. 1 is a sectional structure diagram of a color image forming apparatus showing an embodiment of the invention.

FIG. 1 is a sectional structure diagram of a color image forming apparatus showing an embodiment of the invention.

The color image forming apparatus stated above is one called a tandem type color image forming apparatus, and it is composed of a plurality of image forming sections 10Y, 10M, 10C and 10K, intermediate transfer unit 7, a sheet conveyance means and fixing unit (fixing means) 24. On top of image forming apparatus main body (hereinafter referred to as apparatus main body) A, there is arranged document image reading unit SC.

The image forming section 10Y that forms yellow images is provided with charging means 2Y arranged around image carrier (photoreceptor) 1Y, exposure means 3Y, developing unit (developing means) 4Y, primary transfer means 5Y and cleaning means 6Y. The image forming section 10M that forms magenta images is provided with image carrier (photoreceptor) 1M, charging means 2M, exposure means 3M, developing unit (developing means) 4M, primary transfer means 5M and cleaning means 6M. The image forming section 10C that forms cyanic images is provided with image carrier (photoreceptor) 1C, charging means 2C, exposure means 3C, developing unit (developing means) 4C, primary transfer means 5C and cleaning means 6C. The image forming section 10K that forms black images is provided with image carrier (photoreceptor) 1K, charging means 2K, exposure means 3K, developing unit (developing means) 4K, primary transfer means 5K and cleaning means 6K.

The intermediate transfer unit 7 has intermediate transfer object 70 in a shape of a semiconductive endless belt trained about plural rollers and supported rotatably.

The intermediate transfer object 70 is stretched longitudinally with primary transfer means 5 (Y, M, C and K) inscribed in the intermediate transfer object 70. The intermediate transfer object 70 representing a belt that is trained about upper and lower rollers is rotated to run vertically by rotation driving of a driving roller performed by an unillustrated driving source. The driven roller impresses tension on the stretched intermediate transfer object 70 to reduce speed fluctuations of the intermediate transfer object 70 caused by creases and skewing.

The intermediate transfer object 70 is an endless belt having volume resistivity of 106–1015 Ω·cm, and an example thereof is a two-layered seamless belt wherein a fluorine coating having a thickness of 5–50 $\mu$m is preferably provided as a toner filming protection layer on the outer side of a (0.1–1.0)-mm-thick conductive film base in which conductive materials are dispersed in engineering plastics such as, denatured polyimde, thermosetting polyimde, ethylene-tetrafluoroethylene copolymer, polyfluorovinylidene and nylon alloy. In addition to the foregoing, a semiconductive rubber belt having a thickness of 0.5–2.0 mm in which conductive materials are dispersed in silicone rubber or urethane rubber can be used as a belt base.

Images each having a different color formed by the image forming sections 10Y, 10M, 10C and 10K are successively transferred onto rotating intermediate transfer object 70 by primary transfer means 5Y, 5M, 5C and 5K, and thereby, a composite color image is formed. Sheet P housed in sheet feeding cassette 20 is fed out by sheet feeding means 21 to be conveyed to secondary transfer means 5A through plural intermediate rollers 22A, 22B, 22C, 22D and registration roller 23, thus, color images are transferred collectively onto the sheet P. The sheet P on which the color images have been transferred is subjected to fixing processing by fixing unit 24, then, is nipped by sheet ejection rollers 25 and is placed on sheet ejection tray 26 located outside the apparatus.

On the other hand, after color images are transferred onto sheet P by the secondary transfer means 5A, toner remaining on the intermediate transfer object 70 from which the sheet S is curvature-separated is removed by cleaning means 6A.

In the course of image forming processing, primary transfer means 5K is in pressure contact constantly with photoreceptor 1K. Other primary transfer means 5Y, 5M and 5C come in pressure contact with their corresponding photoreptors 1Y, 1M and 1C respectively.

In this case, the secondary transfer means 5A is a roller-shaped transfer means (transfer roller).

The secondary transfer means 5A is provided below intermediate transfer object 70, and d.c. voltage is impressed, or d.c. voltage plus a.c. voltage are impressed on the secondary transfer means 5A so that superposed toner images on the intermediate transfer object 70 are transferred onto the surface of a sheet.

This roller-shaped secondary transfer means 5A, when it is arranged to be combined with intermediate transfer object 70 that is arranged longitudinally, attains high transfer power and makes the layout having high degree of freedom to be possible. In the apparatus shown in FIG. 1, a sheet is housed at the lower portion of the apparatus main body, and an intermediate transfer object that carries toner images is arranged over the sheet. Further, a floor space can be reduced sharply because the intermediate transfer object is arranged longitudinally. Though fixing unit 24 is also arranged over a sheet housing section in the apparatus shown in FIG. 1, the intermediate transfer object 70 is of a longitudinal type, and a sheet can be fed out from the lower portion of the intermediate transfer object in any direction by the roller-shaped secondary transfer object 5A, when a sheet is conveyed to the fixing unit 24. Further, though leakage of an electric current tends to be generated at the position other than an original transfer position because the secondary transfer means is in a roller shape, leakage of an electric current from the intermediate transfer object 70 to the secondary transfer means is hardly caused because the intermediate transfer object 70 is a semiconductive object. This means that a toner image can be transferred properly only on the portion where the intermediate transfer object 70 is in contact with the secondary transfer means, and that it is possible to prevent the problem wherein the aforesaid leakage is caused at the location where the intermediate transfer object 70 is not in contact with the secondary transfer means and a toner image scatters before it is transferred. In virtue of the roller-shaped secondary transfer means 5A combined with intermediate transfer object 70 that is arranged above the sheet housing section longitudinally as stated above, high transfer power is attained and the layout having high degree of freedom and down-sizing of the apparatus are realized.

Incidentally, the secondary transfer means 5A comes in pressure contact with the intermediate transfer object 70 only when sheet P passes through the secondary transfer means 5A and secondary transfer is conducted.

Figure 2:
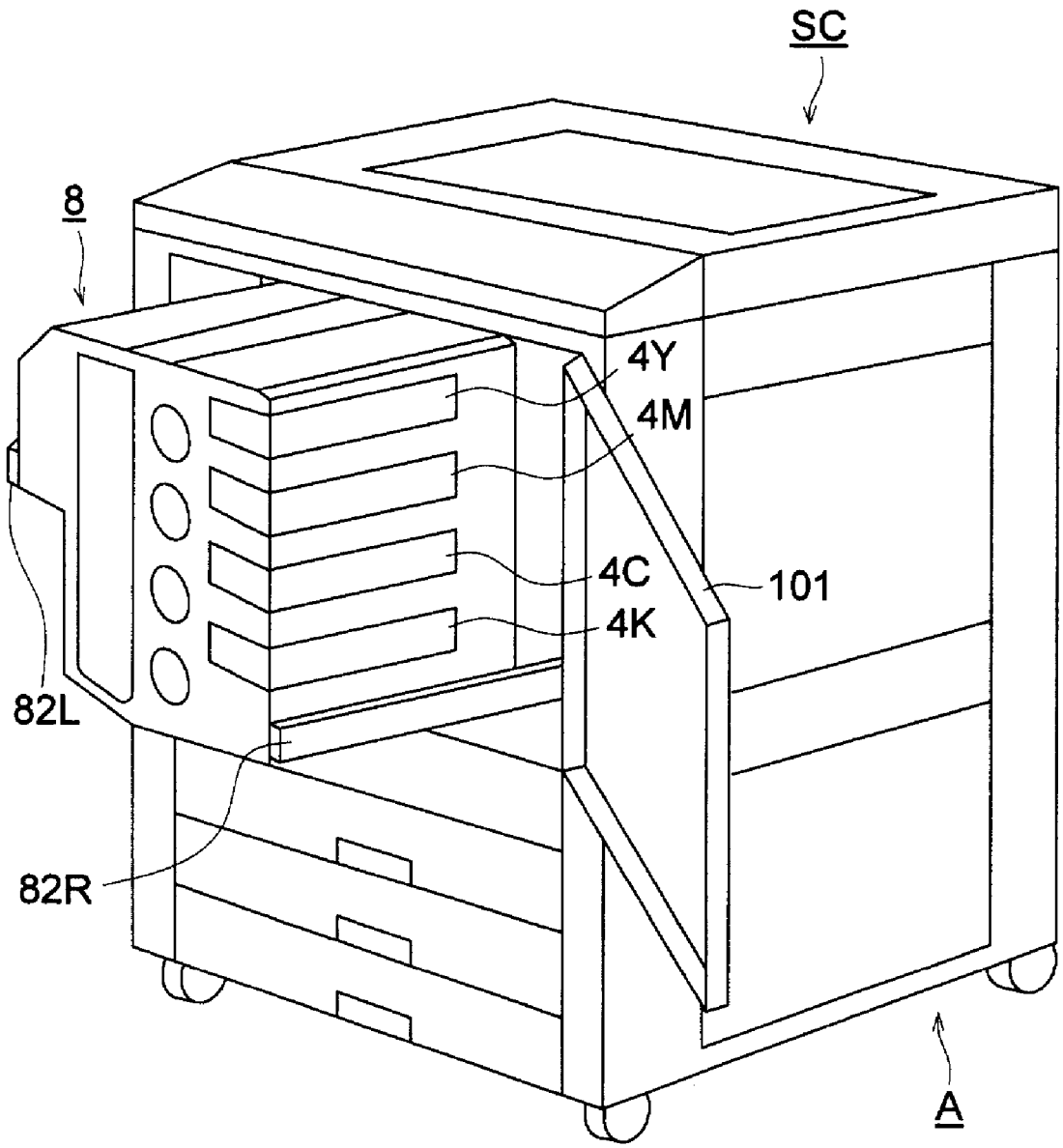
FIG. 2 is a perspective view showing the state wherein a process frame is drawn out of the apparatus main body.
Figure 3:
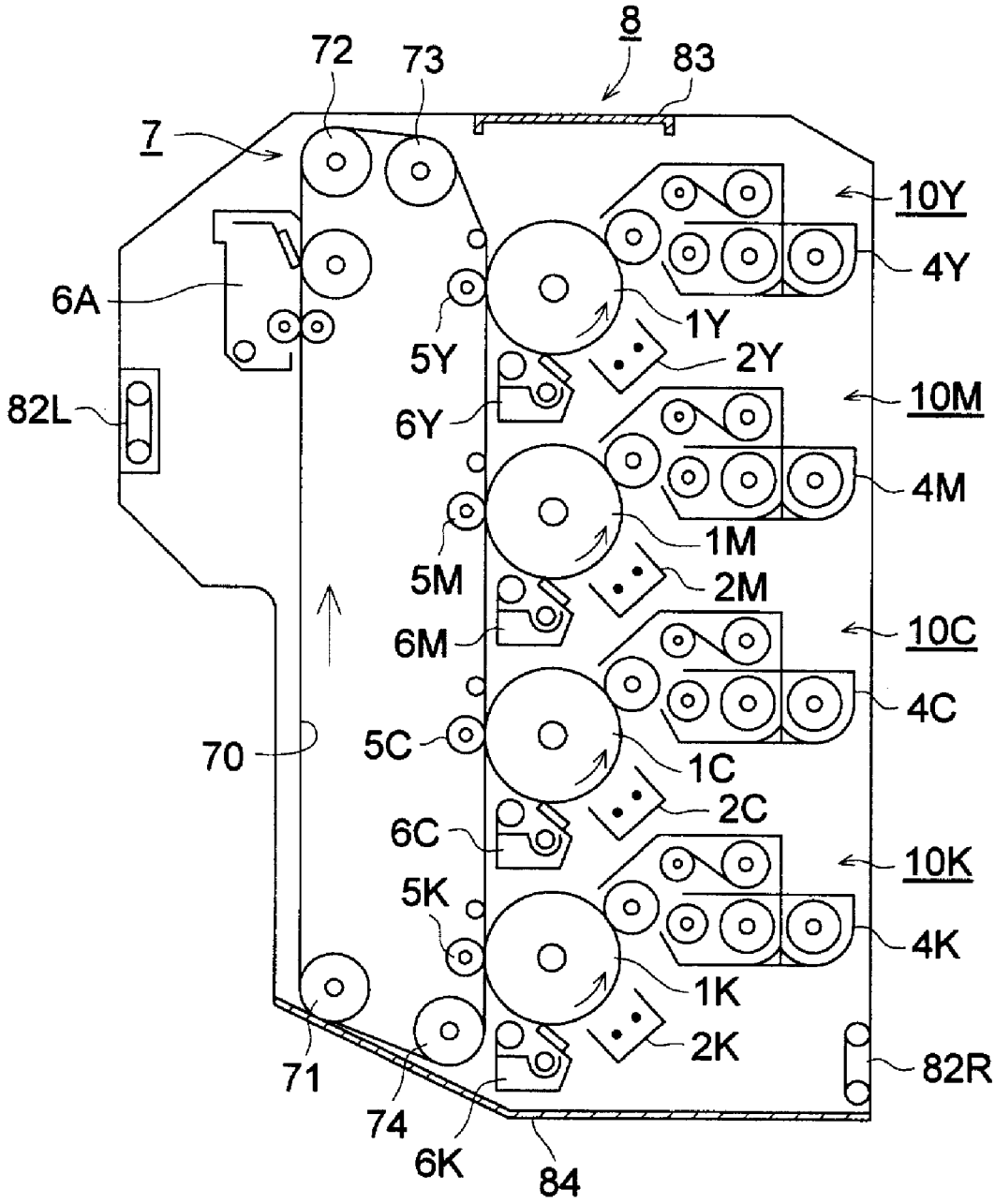
FIG. 3 is a sectional view of an image forming process frame.
Figure 4:
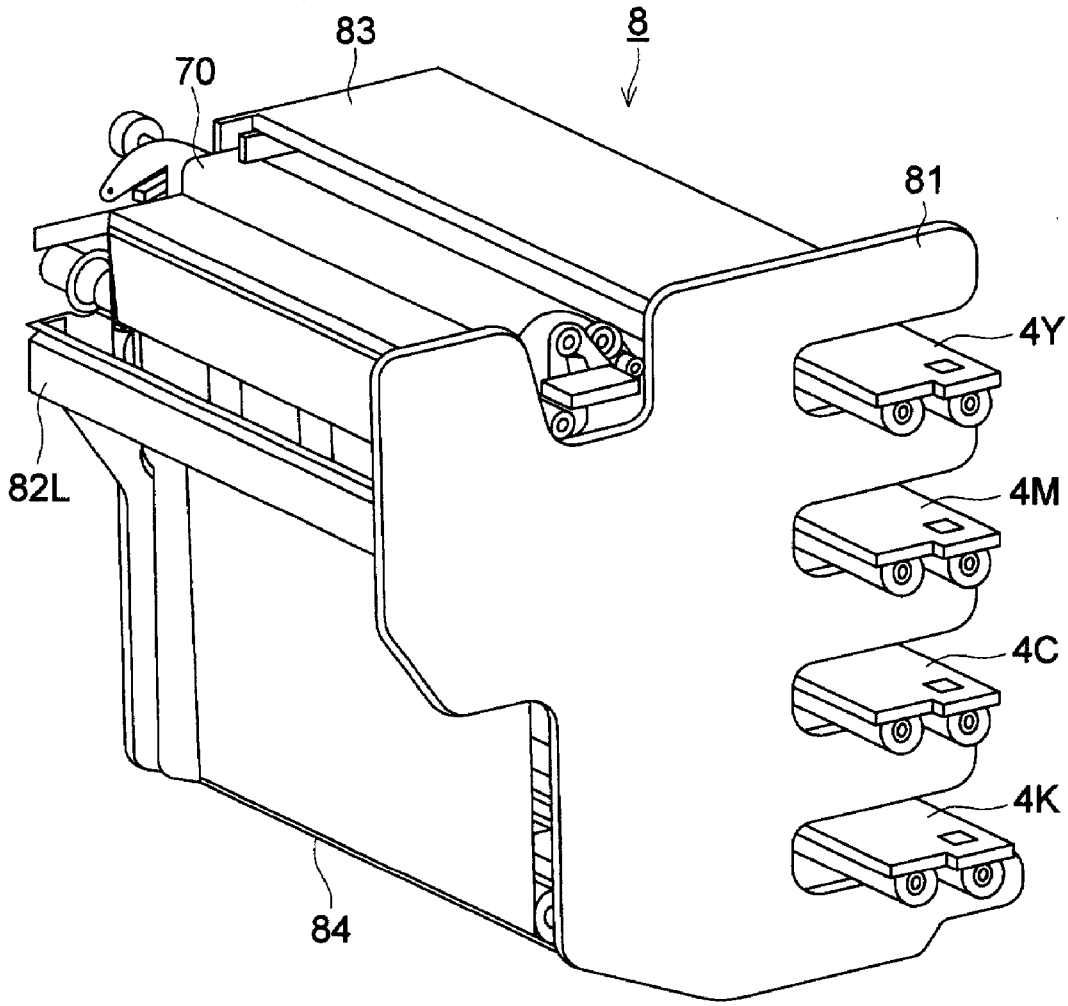
FIG. 4 is a perspective view of an image forming process frame.

FIG. 2 is a perspective view showing the state wherein process frame 8 has been drawn out of apparatus main body A. FIG. 3 is a sectional view of process frame 8, and FIG. 4 is a perspective view of process frame 8.

The process frame 8 is composed of image forming sections 10Y, 10M, 10C and 10K and of intermediate transfer unit 7.

The image forming sections 10Y, 10M, 10C and 10K are arranged longitudinally in the vertical direction. Intermediate transfer unit 7 is arranged on the left side of photoreceptors 1Y, 1M, 1C and 1K in the illustration. The intermediate transfer unit 7 is composed of intermediate transfer object 70 in a shape of an endless belt trained about rollers 71, 72, 73 and 74 to be rotatable, primary transfer means 5Y, 5M, 5C and 5K and cleaning means 6A.

Process frame 8 is capable of being drawn out of apparatus main body A. Namely, front door 101 of the apparatus main body A is opened, and then, the process frame 8 is held to be drawn out to the front side. The process frame 8 slides while being guided by supporting rails 82L and 82R positioned respectively on the left and right, and is drawn out toward the front side. When the process frame 8 is drawn out, image forming sections 10Y, 10M, 10C and 10K and intermediate transfer unit 7 are drawn out of the apparatus main body A collectively and solidly.

Supporting rail 82L on the left side in the illustration of the process 8 is arranged in the space positioned at the upper portion of fixing unit 24 and on the left side of the intermediate transfer object 70. Supporting rail 82R on the right side in the illustration of the process 8 is arranged in the vicinity of the lower portion of the lowermost developing unit 4K. The supporting rail 82R is arranged at the position where operations for mounting developing units 4Y, 4M, 4C and 4K on or dismounting them from the process frame 8 are not interfered. Accordingly, operations for mounting a developing unit and dismounting a developing unit under the condition that the process frame is drawn out and operations for maintenance are easy.

The right side of photoreceptors 1Y, 1M, 1C and 1K of the process frame 8 is surrounded by developing units 4Y, 4M, 4C and 4K, while, the lower portion in the illustration is surrounded by charging means 2Y, 2M, 2C and 2K and by cleaning means 6Y, 6M, 6C and 6K and the left side in the illustration is surrounded by the intermediate transfer object 70.

A space section on the upper portion of photoreceptor 1Y is covered by top plate 83 fixed on casing (frame) 81 of the process frame 8. Bottom plate 84 fixed on casing 81 of the process frame 8 protects the intermediate transfer object 70 while it is mounted or dismounted, and it serves an upper guide plate of a sheet conveyance path.

Figure 5:
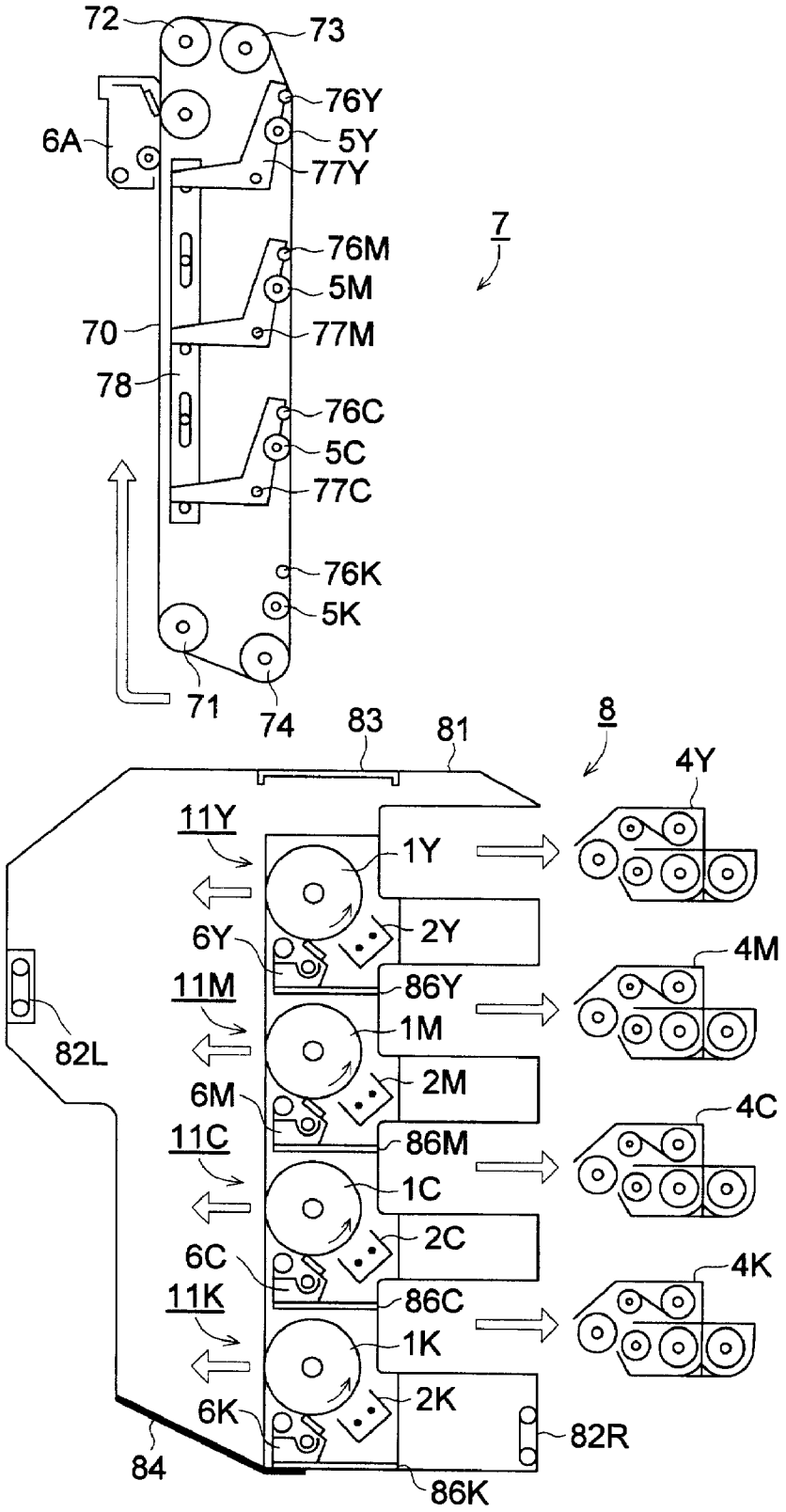
FIG. 5 is an exploded sectional view of a frame, an intermediate transfer unit and an image forming section.
Figure 6:
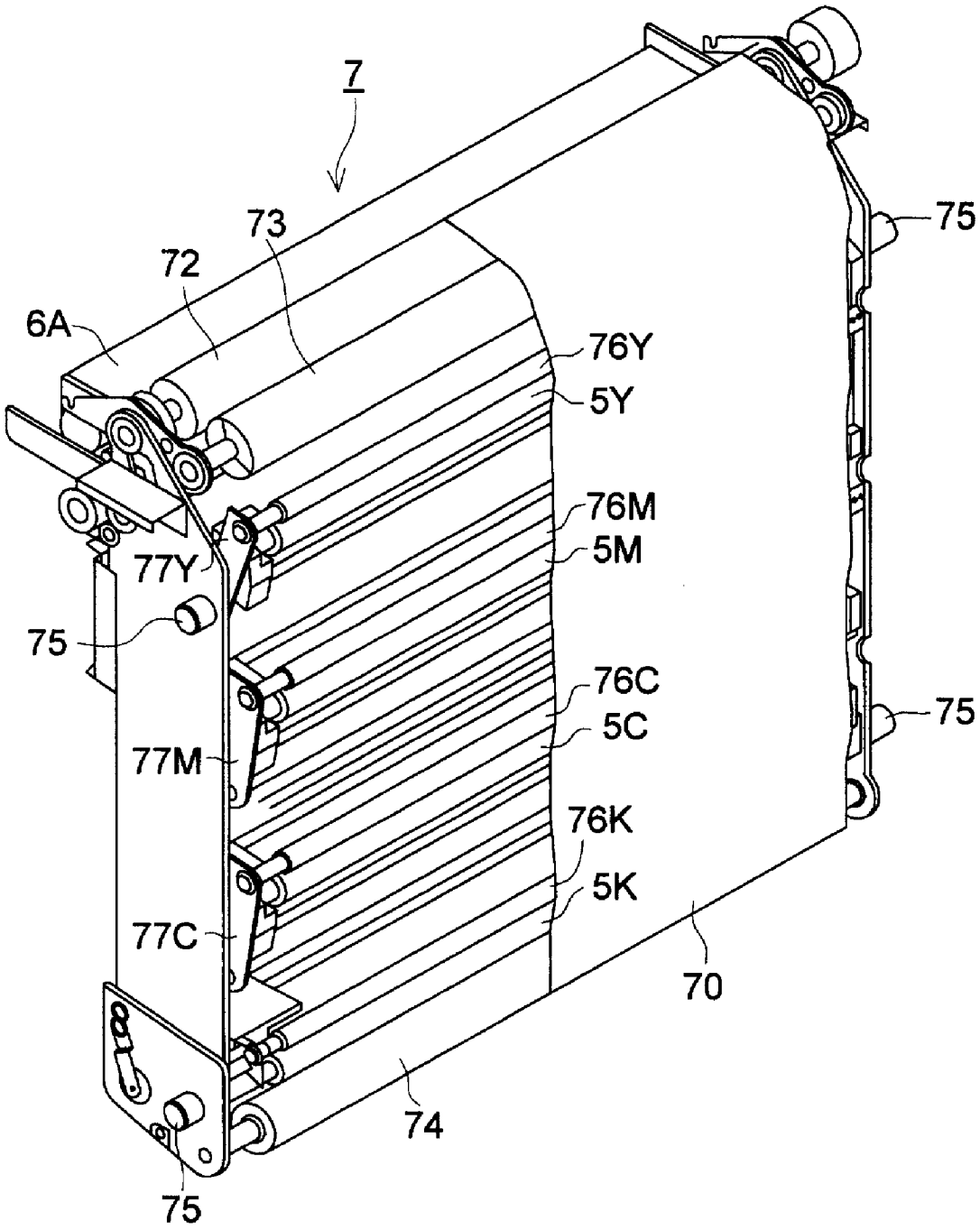
FIG. 6 is a perspective view of an intermediate transfer unit.
Figure 7:
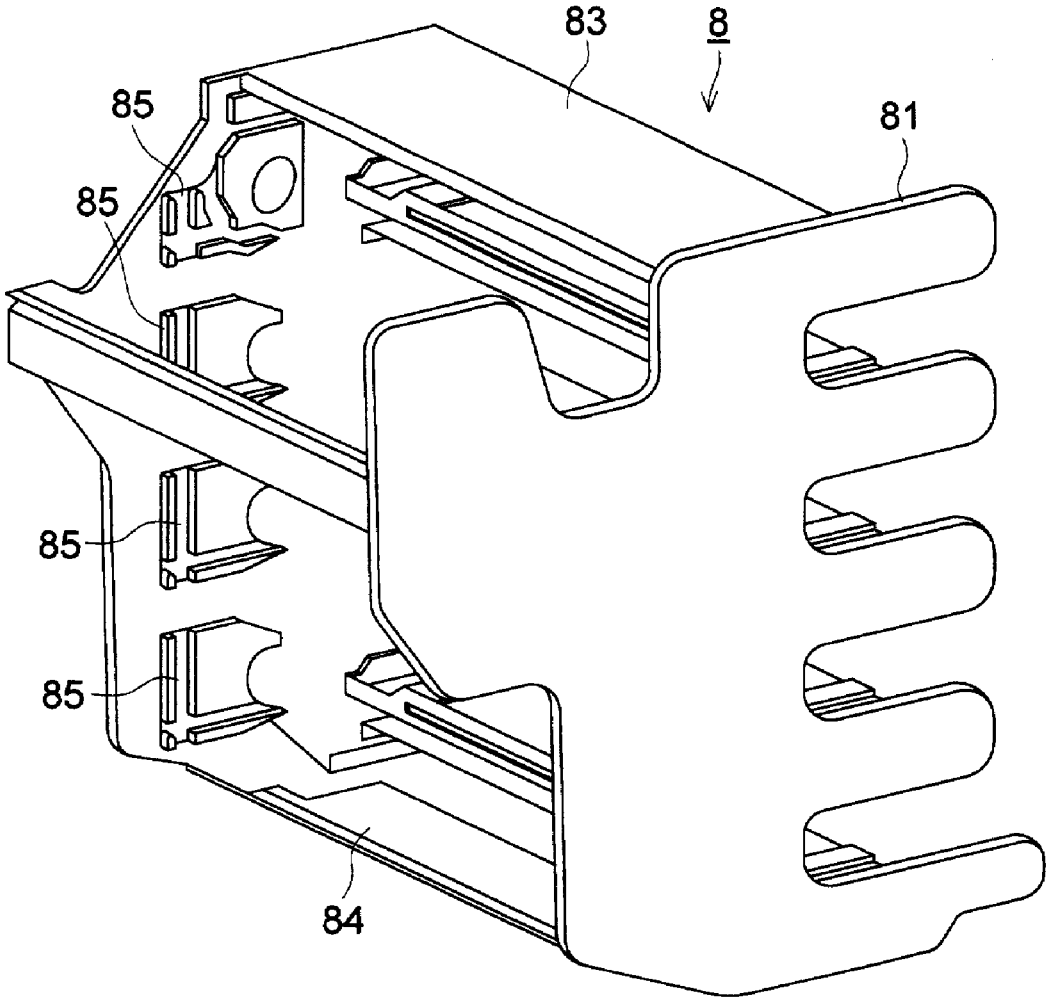
FIG. 7 is a perspective view of a casing.

FIG. 5 is an exploded sectional view showing the state wherein intermediate transfer unit 7 and image forming sections 10Y, 10M, 10C and 10K are removed, FIG. 6 is a perspective view of the intermediate transfer unit 7 and FIG. 7 is a perspective view of casing 81. Incidentally, in FIG. 6, a left half of intermediate transfer object 70 is eliminated so that an inside of the intermediate transfer unit 7 may easily be observed.

After the process frame 8 is drawn out of apparatus main body A, intermediate transfer unit 7 is moved slightly to the left side in the illustration, and then, the intermediate transfer unit 7 is held to be pulled up vertically. Since positioning pins 75 embedded on upper portions on both sides of the intermediate transfer unit 7 move upward vertically along reference grooves 85 provided on the process frame 8, it does not happen that intermediate transfer object 70 comes into contact with a member of the process frame 8 to damage it when the intermediate transfer unit 7 is pulled up.

On the internal surface of the intermediate transfer object 70, there are arranged longitudinally primary transfer means (hereinafter referred to also as primary transfer rollers) 5Y, 5M, 5C and 5K all supported horizontally and pressurizing rollers 76Y, 76M, 76C and 76K. Lever 77Y which supports primary transfer roller 5Y and pressurizing roller 76Y, lever 77M which supports primary transfer roller 5M and pressurizing roller 76M, and lever 77C which supports primary transfer roller 5C and pressurizing roller 76C are rotated by regulating plate 78 simultaneously, and press the intermediate transfer object 70 to release it.

Figure 8:
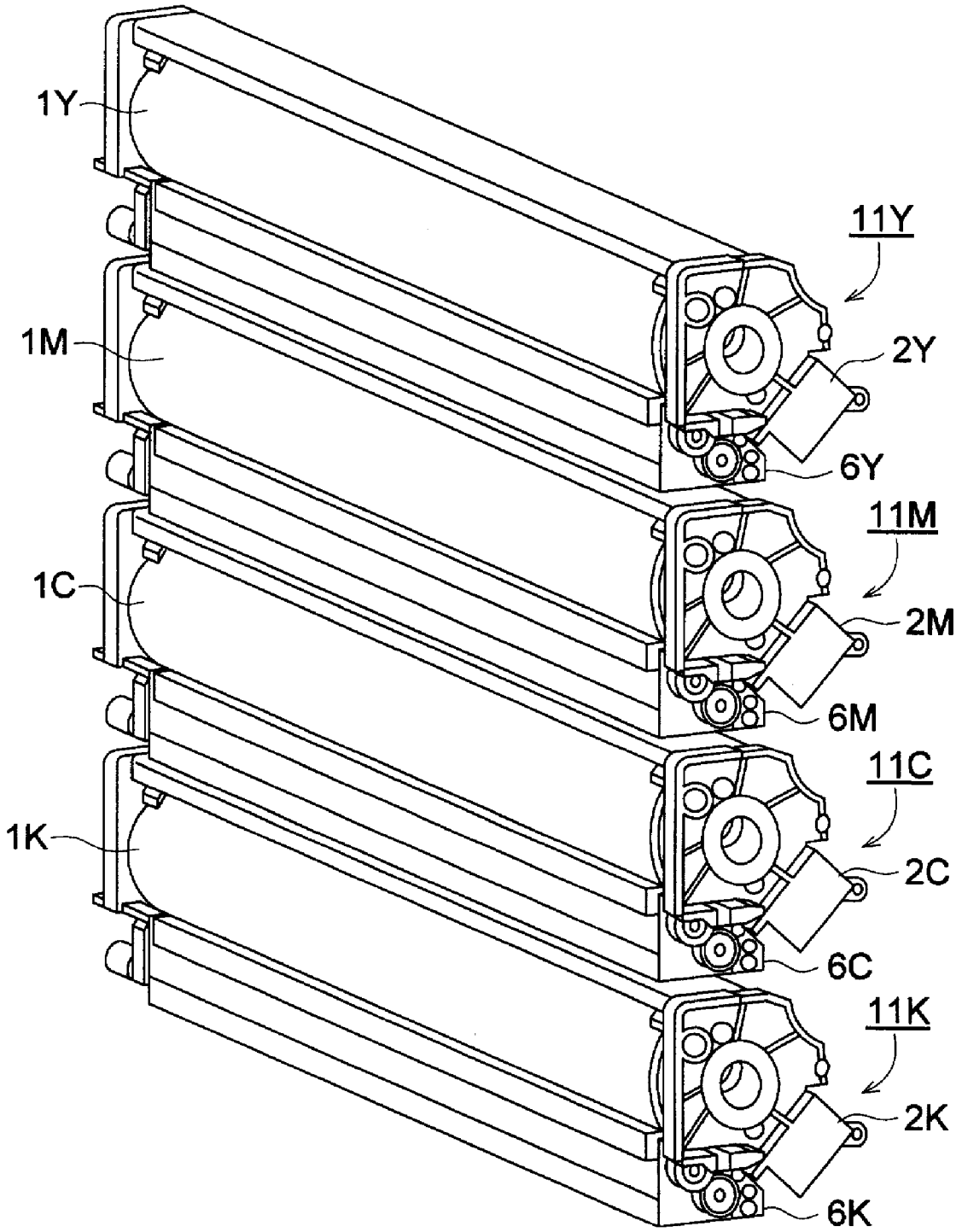
FIG. 8 is a perspective view of four sets of photoreceptor units.
Figure 9:
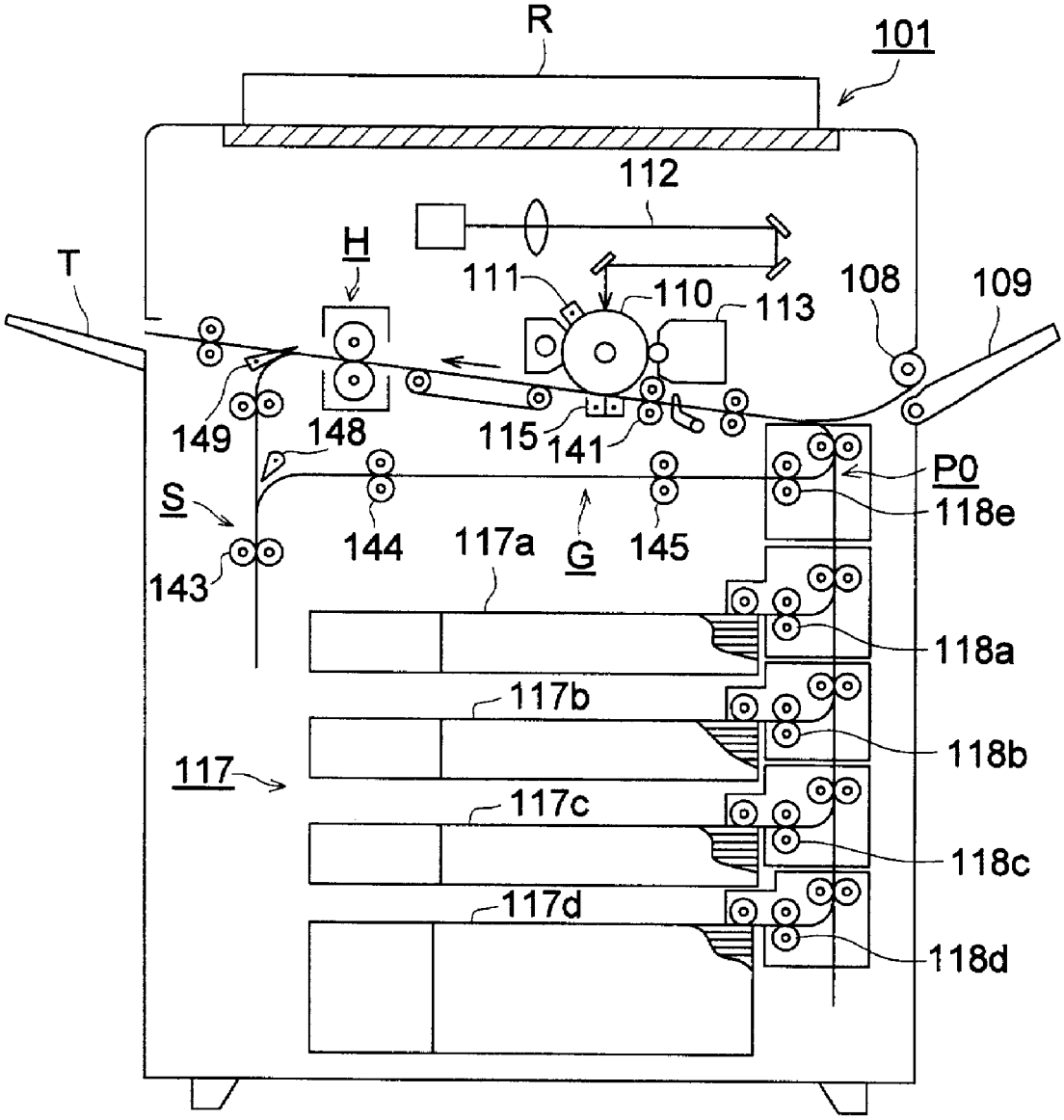
FIG. 9 PRIOR ART
FIG. 9 is an illustrative diagram of a conventional image forming apparatus for forming images on both sides of a sheet.

FIG. 8 is a perspective view of four sets of photoreceptor units 11Y, 11M, 11C and 11K.

After the intermediate transfer unit 7 is removed from the process frame 8, four sets of photoreceptor units 11M, 11C and 11K can be taken out. The photoreceptor unit 11Y on the uppermost step is composed of photoreceptor 11Y, charging means 2Y and cleaning means 6Y. The photoreceptor unit 11M on the second step is composed of photoreceptor 11M, charging means 2M and cleaning means 6M. The photoreceptor unit 11C on the third step is composed of photoreceptor 1C, charging means 2C and cleaning means 6C. The photoreceptor unit 11K on the lowermost step is composed of photoreceptor 1K, charging means 2K and cleaning means 6K.

After the process frame 8 is drawn out of apparatus main body A integrally through the rail, each center hole of each of photoreceptors 1Y, 1M, 1C and 1K leaves an unillustrated reference shaft of each photoreceptor fixed and supported on a cantilever basis in the apparatus main body A to become movable, and photoreceptor units 11Y, 11M, 11C and 11K are placed respectively on supporting rests 86Y, 86M, 86C and 86K of the process frame 8. In this case, it is possible to pull out only intermediate transfer unit 7 upward easily because the process frame 8 including the intermediate transfer unit 7 has been drawn out to the front side of the apparatus. Since the intermediate transfer unit 7 is extended almost in the vertical direction, it is extremely easy to pull it out upward. It is also excellent in terms of balance in pulling out. Namely, it is easy to pull out the intermediate transfer unit 7 by avoiding the contact between the intermediate transfer object and other member because it is possible to pull out in a well-balanced way in the direction which makes it easy for a user to apply its power. Further, in the intermediate transfer unit extended almost in the vertical direction as stated above, a risk of contact with other apparatus can be reduced sharply because an area necessary for pulling out upward is small.

Next, photoreceptor unit 11Y from which the intermediate transfer unit 7 has been drawn out is made to slide on supporting rest 86Y to be moved in the void arrow direction shown in FIG. 5, thus photoreceptor unit 11Y can be taken out from a space section from which the intermediate transfer unit 7 is removed. Photoreceptor units 11M, 11C and 11K can be taken out respectively of supporting rests 86M, 86C and 86K in the same way.

Because of the state where the process frame 8 has been drawn out and the state where the intermediate transfer unit 7 has been removed, each photoreceptor unit can be taken out safely without interference with the intermediate transfer unit 7. The risk of interference with other members can further be reduced because it is possible to mount or dismount not through movement in the axial direction of the photoreceptor but through movement for the shortest distance.

Developing unit 4Y facing photoreceptor 1Y, developing unit 4M facing photoreceptor 1M, developing unit 4C facing photoreceptor 1C and developing unit 4K facing photoreceptor 1K can be taken out respectively from the prescribed housing sections of the process frame 8 in the void arrow directions on the right side in FIG. 5.

In virtue of this mounting and dismounting mechanism, it is not necessary to provide many guide rails for each member, a total apparatus can be made small and each member is not damaged, resulting in a color image forming apparatus wherein a burden for a user is extremely small and maintenance is easy.

The process frame 8 is made to slide along supporting rails 82L and 82R to be mounted on apparatus main body A, and it is stopped at a prescribed position to be fixed by an unillustrated locking lever. A frame operation detection means is a means to detect that the process frame 8 has been mounted at the prescribed position on the apparatus main body A. The frame operation detection means detects by the use of a sensor that the process frame 8 is topped at the prescribed position. Or, the frame operation detection means detects that the locking lever has completed the prescribed operations.

In the embodiment stated above, there has been explained intermediate transfer object 70 in a shape of an endless belt to which, however, the invention is not limited, and an intermediate transfer object in a shape of a seamed endless belt can also be used.

Further, in the color image forming apparatus of the invention, it is also possible to use a light emitting element (LED) array as each of exposure means 3Y, 3M, 3C and 3K and to arrange it at the prescribed position in the process frame 8.

Furthermore, the invention is not limited to the embodiment stated above, and it can be applied also to another color image forming apparatus equipped with an image carrier (including an electrostatic recording body), an intermediate transfer object, and a plurality of developing units (including a wet developing unit, and ion current control system).

In virtue of the color image forming apparatus wherein an image forming means such as an image carrier and an intermediate transfer unit is arranged on a process frame, and the image forming means such as an image carrier and an intermediate transfer unit can be taken out under the state wherein the process frame has been drawn out from the front side near an operator of the apparatus main body, operations and maintenance have been greatly improved to be easy.

Further, a plurality of developing units are arranged on the process frame, and an intermediate transfer unit and the developing unit are made to be capable of being mounted and dismounted from a different side under the state wherein the process frame has been drawn out from the front side near an operator of the apparatus main body, and thereby, mounting and dismounting of the intermediate transfer unit and the developing unit can be conducted without performing mounting and dismounting operations for other members, which makes operations to be easy.

Further, by virtue of the structure wherein a process frame can be drawn out of the apparatus main body after the pressure contact between an intermediate transfer object and a transfer means is released, it does not happen that the intermediate transfer object and the transfer means are damaged by operations to draw out the process frame.

Furthermore, by virtue of the structure wherein a process frame is drawn out to the front side of the apparatus main body and a plurality of photoreceptors can be taken out in front of the apparatus main body accordingly, it is possible to take out the process frame without securing a large floor space, and operations of a user are made easy.

Next, functions to form images on both sides of a sheet will be explained as follows.

In FIG. 1, image forming apparatus 100 further has therein sheet feeding section 117, reversing means S, bypass sheet feeding section 109, first sheet conveyance path P1, second sheet conveyance path G and third sheet conveyance path Q.

The sheet feeding section 117 is equipped with a plurality of sheet feeding units 117*a*–117*c*, and selects the sheet feeding unit housing a sheet on which an image is to be formed from a plurality of sheet feeding units.

The reversing means S is equipped with guide 48 and a pair of switchback rollers 43 capable of rotating regularly and conversely, and it reverses a sheet inside out in the second sheet conveyance path.

The first sheet conveyance path P1 is a conveyance path for a sheet provided to convey the sheet fed from a sheet feeding unit of the sheet feeding section 117 toward intermediate transfer object 70.

The second sheet conveyance path G is a conveyance path for a sheet wherein reversing means S and driving rollers 144 and 145 are provided on the conveyance path, and the sheet on which a toner image has been transferred on its first surface is reversed by the reversing means S to be made to join the first sheet conveyance path P1.

The third sheet conveyance path Q is a conveyance path for a sheet wherein the sheet fed in from the side of image forming apparatus 100 through bypass sheet feeding section 109 is made to join the first sheet conveyance path P1, and it is designed so that a sheet can be fed to intermediate transfer object 70 in a straight line, and therefore, a thick sheet that is difficult to be conveyed from sheet feeding section 117 is inserted therein.

The sheet fed from the sheet feeding section 117 is conveyed toward intermediate transfer object 70 through the first sheet conveyance path P1. The sheet thus conveyed arrives at registration roller 23 provided on the first sheet conveyance path. The registration roller 23 starts rotating in synchronization with superimposed toner images formed on the intermediate transfer object 70 to convey the sheet. The sheet conveyed by the registration roller 23 is overlapped on the superimposed toner images on the intermediate transfer object 70, and thus, the toner images are urged by secondary transfer means 5A to be transferred onto the sheet. After that, the sheet is conveyed to fixing means 23 where toner particles forming the toner images are fused and fixed on the sheet by fixing means H through its heating operations. The sheet on which toner is fixed is ejected to sheet ejection tray 26 through sheet ejection roller 25.

When forming images on the second surface (reverse) of the sheet on which the toner image has been transferred onto the first surface (obverse) thereof, conveyance path switching guide 149 is controlled so that the sheet may be fed in the second sheet conveyance path G.

The sheet fed in the second sheet conveyance path G descends and arrives at switchback rollers 143 of reversing means S. The switchback rollers 143 are composed of a pair of rollers capable of rotating regularly and conversely, and it makes the sheet to be interposed to proceed to a space between plural sheet feeding units provided under the switchback rollers 143 and a side wall of the apparatus main body. In this case, the first surface transferred on the sheet is inclined to the left side. Soon, the switchback rollers 143 stop rotating while they hold the trailing edge of the sheet between them. After that, the rotation in the opposite direction is started and guide 148 is switched so that the sheet may be conveyed to driving rollers 144 and 145. The sheet conveyed to the driving rollers 144 and 145 enters the state wherein its second surface on which no toner image has been transferred faces downward. The driving roller 145 conveys the sheet conveyed thereto to reversing path 146 where the second surface facing downward is changed to face upward by the movement along a gentle circular arc, so that the sheet may join the first sheet conveyance path P1 from the second sheet reversing path. Namely, the sheet joins the first sheet conveyance path P1 from the second sheet conveyance path G after it is reversed inside out by reversing means S of the second sheet conveyance path G.

The point of confluence of the second sheet conveyance path G and the first sheet conveyance path P1 is on the downstream side of point of confluence Z of the third sheet conveyance path Q and the first sheet conveyance path P1 for a sheet coming from bypass sheet feeding section 109, when viewed in the sheet conveyance direction, and it is provided at the upstream side of registration roller 23. Therefore, the distance for conveying a sheet from the second sheet conveyance path G to the registration roller 23 is shorter, and sheet conveyance time is shortened. In addition, it is not necessary to provide reversing path 146 of the second sheet conveyance path G above sheet feeding section 21 of the sheet feeding section 117.

As is apparent from FIG. 1, the reversing path of the second sheet conveyance path G is arranged to be closer to the central portion of the main body than the sheet feeding means. In the apparatus shown in FIG. 1, each sheet feeding means 21 is shifted in the horizontal direction to be arranged, and the sheet feeding means positioned to be highest is arranged at the central portion of the main body. Therefore, the reversing path of the second sheet conveyance path G is arranged to be shifted from sheet feeding means 21 positioned to be highest in the horizontal direction. This makes a height of reversing section 90 for the sheet conveyed from the sheet feeding unit to be common to that of reversing path 146 of the second sheet conveyance path G. Therefore, in the image forming apparatus having therein an intermediate transfer object representing a belt that is trained about the upper and lower rollers and runs longitudinally, in particular, an effect of space saving for image forming apparatus 100 is great.

The sheet which has been reversed inside out by reversing means S is guided by the second sheet conveyance path G to registration roller 23 that starts rotating from the position of the point of confluence with the first sheet conveyance path P1, through sheet conveyance by driving roller 145. In this case, driving roller 145 provided on the second sheet conveyance path G feeds the sheet reversed inside out to the point of confluence, and conducts conveyance of the sheet from the point of confluence to the registration roller 23 provided on the first sheet conveyance path P1. Accordingly, it is not necessary to provide on the first sheet conveyance path P1 an additional driving roller for the confluence of the sheet coming from the second sheet conveyance path G.

The sheet coming from the second sheet conveyance path G which has arrived at the registration roller 23 forms a loop with its leading edge being in contact with the registration roller 23. Skewing of the sheet generated in the course of conveyance through the second sheet conveyance path G is corrected by the loop formation. The load for conveyance for driving roller 145 is higher than that for other driving rollers, because the driving roller 145 needs to make a sheet loop in addition to conveying the sheet from reversing path 146 in a shape of a circular arc to the registration roller 23. Therefore, a power of the driving roller 145 to convey a sheet is greater than that of other rollers.

On the other hand, on intermediate transfer object 70, there is formed a toner image, and registration roller 23 starts rotating in synchronization with the toner image formed on the intermediate transfer object 70 to convey a sheet.

The registration roller 23 starts rotating in synchronization with superimposed toner images formed on the intermediate transfer object 70 to convey the sheet. The second toner image on intermediate transfer object 70 is overlapped on the second surface of the sheet conveyed in synchronization with the intermediate transfer object 70, and thus, the toner image is urged by transfer means 5A to be transferred on the second surface of the sheet. After that, the sheet is subjected to fixing processing and is ejected on sheet ejection tray 26 through sheet ejection roller 25.

A plurality of image carriers are arranged on the side where intermediate transfer object 70 runs from the upper portion to the lower portion to shorten a distance of the second sheet conveyance path G where a sheet is reversed inside out, and to shorten a distance to transfer means 5A positioned at the lower portion of the intermediate transfer object 70, and thereby to shorten the time for image forming.

In the structure stated above, the time for forming images on both sides of a sheet has been shortened and space saving has been attained.

Disclosed embodiment can be varied by a skilled person without departing from the spirit and scope of the invention.

What is claimed is:

1. A color image-forming apparatus, comprising:

a plurality of image carriers;

a plurality of latent image forming devices to form electrostatic latent images on said image carriers;

a plurality of developing devices to develop said electrostatic latent images with toner to form visible toner images on said image carriers;

an intermediate transfer member, a longitudinal direction of which is arranged at substantially a vertical direction, and onto which said toner images formed on said image carriers are sequentially transferred in such a manner that said toner images overlap relative to each other so as to form a color toner image on said intermediate transfer member; and a transferring device to transfer said color toner image formed on said intermediate transfer member onto a transfer sheet;

wherein at least said intermediate transfer member and said image carriers are integrated into a rack, and said rack is drawable in substantially a horizontal direction in respect to a mainframe of said color image-forming apparatus.

2. The color image-forming apparatus of claim 1, wherein said intermediate transfer member is shaped in an endless belt.

3. The color image-forming apparatus of claim 1, wherein said intermediate transfer member is drawable in an upper direction, when said rack is drawn out of said mainframe of said color image-forming apparatus.

4. The color image-forming apparatus of claim 1, wherein said image carriers are arrayed in substantially a vertical direction.

5. The color image-forming apparatus of claim 1, wherein each of said image carriers is detachable in respect to said rack, when said rack is drawn out of a mainframe of said color image-forming apparatus.

6. The color image-forming apparatus of claim 5, wherein each of said image carriers is detachable in respect to said rack, when said intermediate transfer member is drawn out of a mainframe of said color image-forming apparatus.

7. The color image-forming apparatus of claim 6, wherein said rack comprises supporting rests to support said image carriers in said rack, and each of said image carriers is detachable in respect to each of said supporting rests.

8. The color image-forming apparatus of claim 1, wherein said rack is drawable in a front direction of an operator of said color image-forming apparatus.

9. The color image-forming apparatus of claim 1, wherein each of said image carriers is formed in a drum shape.

10. The color image-forming apparatus of claim 1, further comprising:

a supporting rail to movably support said rack so that said rack can be drawn out of said mainframe of said color image-forming apparatus by sliding said rack on said supporting rail;

wherein said developing devices are detachably mounted on said rack, and said supporting rail is disposed at such a position that said supporting rail does not impede operations for detaching said developing devices.

11. The color image-forming apparatus of claim 1, wherein said developing devices are detachably mounted on said rack, and each of said developing devices can be detached in respect to each of said image carriers from a side opposite to said intermediate transfer member.

12. The color image-forming apparatus of claim 1, wherein said developing devices are arrayed in substantially a vertical direction.

13. The color image-forming apparatus of claim 1, wherein said transferring device is capable of both pressing onto and leaving from said intermediate transfer member.

14. The color image-forming apparatus of claim 13, wherein said rack can be drawn out of said mainframe of said color image-forming apparatus, after releasing a press-contacting state between said transferring device and said intermediate transfer member.

15. The color image-forming apparatus of claim 1, wherein each of said latent image forming devices includes at least a charging device and a exposing device.

16. A color image-forming apparatus, comprising:

a plurality of image carriers;

a plurality of latent image forming devices to form electrostatic latent images on said image carriers;

a plurality of developing devices to develop said electrostatic latent images with toner to form visible toner images on said image carriers;

an intermediate transfer member to bear a color toner image formed by superimposing said toner images, which are sequentially transferred onto said intermediate transfer member from said image carriers; and a transferring device to transfer said color toner image formed on said intermediate transfer member onto a transfer sheet;

wherein at least said intermediate transfer member and said image carriers are integrated into a rack, and said rack is drawable in substantially a horizontal direction in respect to a mainframe of said color image-forming apparatus.

17. The color image-forming apparatus of claim 16, wherein said intermediate transfer member is shaped in an endless belt.

18. The color image-forming apparatus of claim 16, wherein said intermediate transfer member is drawable in an upper direction, when said rack is drawn out of said mainframe of said color image-forming apparatus.

19. The color image-forming apparatus of claim 18, wherein a longitudinal direction of said intermediate transfer member is arranged at substantially a vertical direction.

20. The color image-forming apparatus of claim 16, wherein said image carriers are arrayed in substantially a vertical direction.

21. The color image-forming apparatus of claim 16, wherein each of said image carriers is detachable in respect to said rack, when said rack is drawn out of a mainframe of said color image-forming apparatus.

22. The color image-forming apparatus of claim 21, wherein each of said image carriers is detachable in respect to said rack, when said intermediate transfer member is drawn out of a mainframe of said color image-forming apparatus.

23. The color image-forming apparatus of claim 22, wherein said rack comprises supporting rests to support said image carriers in said rack, and each of said image carriers is detachable in respect to each of said supporting rests.

24. The color image-forming apparatus of claim 16, further comprising:

a supporting rail to movably support said rack so that said rack can be drawn out of said mainframe of said color image-forming apparatus by sliding said rack on said supporting rail;

wherein said developing devices are detachably mounted on said rack, and said supporting rail is disposed at such a position that said supporting rail does not impede operations for detaching said developing devices.

* * * * *